US005472526A

United States Patent [19]

Gigliotti, Jr.

[11] Patent Number: 5,472,526

[45] Date of Patent: Dec. 5, 1995

[54] METHOD FOR HEAT TREATING TI/AL-BASE ALLOYS

[75] Inventor: Michael F. X. Gigliotti, Jr., Scotia, N.Y.

[73] Assignee: General Electric Company, Schenectady, N.Y.

[21] Appl. No.: 315,518

[22] Filed: Sep. 30, 1994

[51] Int. Cl.[6] ..... C22C 14/00

[52] U.S. Cl. ..... 148/421; 420/418

[58] Field of Search ..... 148/699, 421; 420/421, 418

[56] References Cited

U.S. PATENT DOCUMENTS

| | | | |
|---|---|---|---|
| 2,892,705 | 6/1959 | Jaffee et al. | 420/418 |
| 4,229,216 | 10/1980 | Paton et al. | 148/699 |
| 5,264,055 | 11/1993 | Champin et al. | 148/699 |
| 5,350,466 | 9/1994 | Larsen, Jr. et al. | 148/421 |

OTHER PUBLICATIONS

"Embrittlement of Ti–Al Alloys in The 6 to 10 Pct Al Range", F. A. Grossley, et al., Journal of Metals, Transactions AIME, pp. 43–46 (Jan. 1957).

"Slip In Titanium–Aluminum Alloys Containing Small Ti3Al Precipitates", J. D. Boyd et al., pp. 1071–1083, an article in a compendium edited by Jaffee et al., Titanium Science & Technology, Cambridge, Mass. (May 2–5, 1972).

"Properties of Age–Hardened Ti–Al Alloys", G. Lutjering, et al., pp. 785–795, ACTA Metallurgica, vol. 18, Jul. 1970.

*Primary Examiner*—Scott Kastler

*Attorney, Agent, or Firm*—Edmund P. Anderson; James Magee, Jr.

[57] ABSTRACT

A method of heat treating Ti/Al-base alloys to improve tensile ductility and reduce the likelihood of in-service embrittlement is disclosed. The method comprises: selecting a Ti/Al-base alloy that contains a mixture of α and α2 phases, heat treating the alloy so as to form a controlled amount of α2 particles, and then cooling the alloy so as to primarily promote the growth of additional α2 on the previously formed particles, rather than the nucleation of new α2 particles. This method may be used with Ti/Al-base alloys that also comprise Sn, Ga and In as alloy constituents, and is believed to be useful for a number of Ti/Al-base engineering alloys. Alloys made by this method have been observed to maintain significant tensile ductility, even after aging at elevated temperatures under load (e.g. creep conditions).

14 Claims, 1 Drawing Sheet

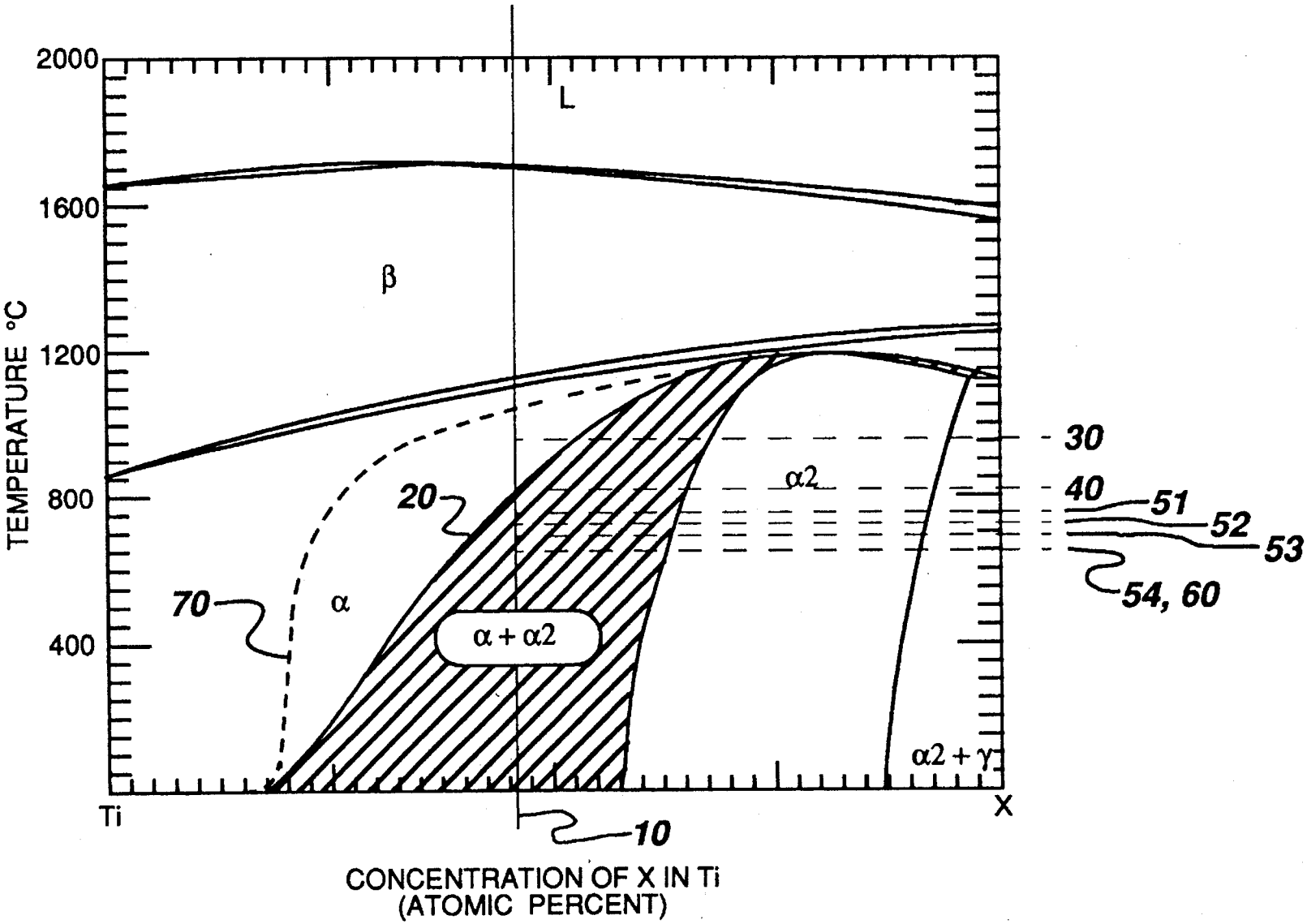
TEMPERATURE °C
2000
1600
1200
800
400
Ti
X
CONCENTRATION OF X IN Ti
(ATOMIC PERCENT)
L
β
α
α2
α2 + γ
α + α2
10
20
30
40
51
52
53
54, 60
70

METHOD FOR HEAT TREATING TI/AL-BASE ALLOYS

BACKGROUND OF THE INVENTION

This invention relates generally to a method for heat treating Ti/Al-base alloys to improve their resistance to embrittlement when exposed to elevated temperatures or creep conditions. More particularly, the method comprises aging Ti/Al-base alloys which comprise a mixture of α (Ti solid solution) and α2 ($Ti_3Al$) phases over a plurality of successively lower elevated temperatures that are each lower than the α/α2 solvus temperature in order to control the particle size and distribution of the α2 phase.

Embrittlement after thermal exposure in titanium alloys is a well-known phenomena. For example, it known that binary Ti/Al alloys are embrittled by the occurrence of a second phase, see Crossley et al., *Embrittlement of Ti—Al Alloys in the* 6 *to* 10 *Pct Al Range*, Journal of Metals, Transactions AIME, pp. 43–46 (January 1957). This embrittlement has also been reported to result in tensile deformation that occurs in sharp bands within Ti-8 Al (in weight percent) alloys due to the shearing of fine $Ti_3Al$ particles; see Boyd et al., *Slip in Titanium Aluminum Alloys Containing Small $Ti_3Al$ Precipitates*, pp. 1071–1083, an article in a compendium edited by Jaffee et al., *Titanium Science and Technology*, Cambridge, Mass. (May 2–5, 1972). This type of embrittlement phenomena is significant, because it occurs at elevated temperatures and when the alloy is under a load, conditions for which it is generally desirable to utilize Ti/Al-base alloys. Thus, this phenomena serves as a significant limitation on the use if these alloys.

It has also been reported that the tensile ductility of Ti—Al solid solution alloys can be improved somewhat by long time isothermal treatments at high temperatures to form large diameter $Ti_3Al$ precipitates. The mechanism associated with this improvement was reported to be a transition from dislocation cutting to dislocation by-pass related to increases in the particle size and inter-particle spacing which resulted from the isothermal heat treatment, see Lütjering et al., *Mechanical Properties of Age-Hardened Titanium-Aluminum Alloys*, Acta Metallurgica Vol. 18, pp. 785–795, (1970). However, this work only reported on the results due to isothermal aging, and further reported that small precipitates remained in these isothermally heat treated alloys upon cooling to room temperature. Also, this reference did not discuss the behavior of these alloys under creep conditions, i.e., under load at an elevated temperature.

SUMMARY OF THE INVENTION

The invention is a method of heat treating a Ti/Al-base alloy, comprising the steps of: selecting a Ti/Al-base alloy, wherein the Al concentration is such that the alloy comprises a mixture of α and α2 phases under equilibrium conditions at room temperature; heat treating the alloy at a temperature which is above a α/α2 solvus temperature of the alloy for a time sufficient to dissolve substantially all of the α2 phase; forming a plurality of α2 particles within the alloy by cooling the alloy to a temperature which is in the range of about 1°–200° C. less than the α/α2 solvus temperature of the alloy; and cooling the alloy slowly to a temperature of about 650° C. or less, wherein the rate of cooling is sufficiently slow to permit the formation of an additional quantity of the α2 phase consistent with the phase equilibria relationships of the alloy, and wherein the cooling rate is sufficiently slow to permit substantially all of the additional quantity of α2 to be formed on the existing α2 particles.

Alternately, so as to avoid the need for supersolvus heat treatment, the invention may also be described as a method of heat treating a Ti/Al-base alloy, comprising the steps of: selecting a Ti/Al-base alloy, wherein the Al concentration is such that the alloy comprises a mixture of α and α2 phases under equilibrium conditions at room temperature; heat treating the alloy at a subsolvus temperature in the range of 1°–200° C. below a α/α2 solvus temperature of the alloy for a time sufficient to form substantially all of an equilibrium amount of the α2 phase associated with the subsolvus temperature, in the form of a plurality of α2 particles; and cooling the alloy slowly to a temperature of about 650° C. or less, wherein the rate of cooling is sufficiently slow to permit the formation of an additional quantity of the α2 phase consistent with the phase equilibria relationships of the alloy, and wherein the cooling rate is sufficiently slow to permit substantially all of the additional quantity of α2 to be formed on the existing α2 particles.

The present invention addresses a widely recognized problem, namely that of in-service embrittlement of Ti/Al-base alloys. The method also represents an improvement over related art methods of isothermally annealing such alloys.

BRIEF DESCRIPTION OF THE DRAWINGS

FIG. 1 is a schematic representation of a portion of a phase diagram which includes an alloy suitable for use in the method of the present invention.

DETAILED DESCRIPTION OF THE INVENTION

It is desirable to improve the resistance of Ti/Al-base alloys to embrittlement at elevated temperatures, particularly elevated temperatures under various loads; conditions which favor creep within these alloys. This is particularly the case for Ti/Al-base alloys which comprise a mixture of α and α2 phases at room temperature. These alloys are known to have the necessary strength, ductility and other characteristics to be useful in high temperature applications, but are also known to exhibit embrittlement as described above; even after isothermal aging as discussed above and in the specification and examples which follow. As noted in the reference by Lütjering et al. noted above, isothermally aged alloys contained fine precipitates in addition to larger precipitates grown during the isothermal aging heat treatment. Applicant believes that these fine precipitates which are subject to dislocation shearing, and thus may give the alloys which contain them embrittled characteristics, resulted from quenching the aged alloys after the isothermal heat treatment, and reflected the increased quantity of α2 ($Ti_3Al$) available at room temperature due to the reduced solubility limits of Al in Ti at the quench temperature. This conclusion is based on consideration of the Ti/Al binary phase diagram (not shown).

Applicant has discovered a method for making Ti/Al-base alloys which comprise a mixture of α and α2 phases at room temperature so as to obtain significant tensile ductility. Further, as discussed in the examples below, alloys made by this method have been observed to maintain significant tensile ductility, even after aging at elevated temperatures under load (e.g. creep conditions).

Briefly, the method comprises: selecting a Ti/Al-base alloy that contains a mixture of α and α2 phases, heat treating the alloy so as to form a controlled amount of α2 particles, and then cooling the alloy so as to primarily promote the growth of additional α2 on the previously formed particles, rather than the nucleation of new α2 particles. The method is explained in greater detail below.

The first step of the method comprises selecting an Ti/Al-base alloy that comprises a mixture of α and α2 phases at room temperature. In the case of binary Ti/Al alloys, compositions of the present invention would comprise about 7–23 percent Al in atomic percent. Preferred alloy compositions, particularly for high temperature applications, would comprise about 15–23 atomic percent. However, the method of the present invention is not limited in applicability to binary Ti/Al alloys. In particular, it is applicable to multi-component Ti/Al-base alloys having Sn, Ga, and In, or combinations of these elements, as alloy constituents. These elements are well-known as substitutes for Al in Ti/Al-base alloys. They are also capable of forming $Ti_3M$ compounds, where M represents any of these elements, as does Al. Other alloy constituents are also possible, for instance, in the examples described below, the alloy comprised Ti- 6.6Al-2.7Sn-3.0Zr-2.6Hf-1.0Cb-0.3Ru-0.4Si-0.3Ge, in weight percent. Also, while the examples describe one experimental composition, the method of this invention is expected to be broadly applicable to commercially available titanium alloys, particularly those with high levels of Al and Sn, such as those known by the tradenames: TIMETAL 1100 (nominally Ti- 6Al-2.7Sn-4Zr-0.4Mo-0.45Si, in weight percent); Ti 6242S (nominally Ti-6Al-2Sn-4Zr-2Mo-0.1Si, in weight percent); IMI 829 (nominally Ti-6.1Al-3.2Zr- 3.3Sn-1Nb-0.5Mo-0.32Si, in weight percent) and IMI 834 (nominally Ti-5.8Al-4Sn-3.5Zr-0.7Nb-0.5Mo- 0.35Si-0.06C, in weight percent). It is permissible that other phases be present in addition to α and α2, such as the β phase as occurs with some ternary and multi-constituent alloys. Applicant also believes that it is preferred that the alloy comprise about 25 percent or more of the α2 phase by volume. This is a practical consideration to allow for sufficient quantities of α2 to significantly improve the strength and ductility of the alloy. Also, as discussed further below, the useful service temperatures of alloys made by this method are related to the alloy composition and the solubility characteristics of the Ti solid solutions, such that to obtain higher useful service temperatures the noted quantities of α2 are preferred. Selected alloy may be made by known techniques for making Ti/Al-base alloys, including vacuum arc melting and others. They may also be thermomechanically processed prior to their selection, as by forging or extrusion, as discussed in the examples below The remainder of the steps can be illustrated by referring to FIG. 1, which is a schematic illustration of a portion of a phase diagram for Ti—X alloys generally, where X is the combined quantity of Al, Sn, Ga and In present. The selected alloy illustrated is an alloy of composition 10. The solubility limit of X in Ti solid solution is represented by the α/α2 solvus curve 20.

The next step comprises forming a plurality of particles of the α2 phase in a controlled manner. This may be done in at least two ways. One way is to heat the selected alloy to a temperature 30 that is above the α/α2 solvus temperature 40 so as to dissolve substantially all of the α2 phase and then cool the alloy to a temperature 50 that is slightly under the α/α2 solvus temperature. If the annealing time above the α/α2 solvus temperature is sufficient, all of the α2 is dissolved, and cooling the alloy to temperature 50 renucleates a controlled quantity of α2 as particles. The amount of α2 is a function of the X solubility limits in the Ti solid solution at the temperature to which the alloy is cooled, and could be calculated in this example using known techniques such as the lever rule, with appropriate conversions between atomic, weight and volume percent as necessary. Applicant believes that temperature 50 should be in the range of about 1°–200° C. below the solvus 40 for most selected alloys. Temperature 50 must be lower than solvus 40 in order for the α2 to form, and should be sufficiently high to control the quantity of α2 particles that form. By utilizing a temperature 50 which is no more than 200° C. below the solvus temperature, the quantity of α2 available to form particles should be relatively small, and hence the number of nucleating particles may be controlled.

A second way that the particles may be formed is by heating a selected alloy to a temperature 40 directly, and holding the alloy at temperature 40 for a time sufficient for all but the equilibrium, or near equilibrium, amount of α2 to go back into the Ti solid solution. This step would have a similar effect as described above, in that it would control the number of α2 particles within the alloy. This would also be the same result as if the first step was employed without allowing sufficient time above the solvus 40 for all of the α2 to dissolve.

After forming a controlled amount of α2 particles, the next step in the method of the present invention involves cooling the selected alloy slowly from temperature 50 near its α/α2 solvus 40 to a temperature 60 that is greater than the maximum use temperature desired for the alloy. Cooling slowly from temperature 50 near solvus 40 temperature produces a reduced number of $Ti_3Al$ particles as compared to rapid cooling of the same alloy from such a temperature. Slow cooling permits the increased quantity of $Ti_3Al$ that is formed in alloy 10 at lower temperatures to form on the existing particles, rather than forming as newly precipitated particles. This tends to reduce the occurrence of fine particles as discussed in the Lütjering et al. reference, and promotes the development of a more desirable substantially homogeneous distribution of larger particles as also discussed in this reference. This step of slow cooling should be done to a temperature that is greater than the maximum use temperature desired for the selected alloy 10, because it will ensure that the essential particles produced by this step will not be subsequently dissolved. Dissolution of these particles would be expected to effect the alloy property improvements realized by employment of this method. Hence, the lower temperature bound employed in this step of slow cooling serves as a practical limit on the maximum use temperature of alloy 10. For many Ti/Al-base alloys, Applicant believes that the lower temperature bound during the step of slow cooling, and hence the upper bound of the use temperature, would be about 650° C.

This step of slow cooling may be accomplished in at least two ways. One way would be to slowly cool selected alloy 10 in a plurality successive, discrete time/temperature aging cycles Each successive cycle would have a starting temperature, an ending temperature and a duration. Each cycle would have a lower starting temperature than the starting temperature of the previous cycle. The starting temperatures are represented schematically on FIG. 1 as temperatures 51, 52, 53, and 54, however, the actual number of cycles employed is flexible with respect to a given alloy. During a cycle, the temperature may be held constant for most of the cycle and then lowered to the ending temperature which will in most cases be the starting temperature of the next cycle, or the temperature may be ramped or continuously cooled throughout a cycle to reach the ending temperature. The duration of a cycle should be sufficient to allow the equilibrium quantity of α2 associated with the cycle temperature to form. A second way to perform the step of slow cooling would be to continuously cool selected alloy 10 at a slow rate from temperature 50 to temperature 60. The step of slow cooling is further illustrated in the examples described below.

Referring again to FIG. 1, it is preferred to select the alloying constituents of the alloy so as to develop an alloy with a steeply sloped $\alpha/\alpha 2$ solvus as exemplified by solvus line 70. Obviously, the binary Ti—Al phase relationship is fixed, and ternary or higher order alloys cannot be properly represented by FIG. 1, but solvus 10 is only intended to represent the essential nature of a more steeply sloped solvus relationship, one which may be possible by proper selection of alloying constituents. The reason why such a solvus relationship is more preferred is that it would allow higher use temperatures for the alloy, because more $\alpha 2$ would be available at higher temperatures. Thus the particles formed by the method would not be as sensitive to subsequent dissolution.

A heat treatment study as described in the examples below was conducted on a Ti/Al-base alloy having a composition in weight percent of: Ti-6.6Al- 2.7Sn-3.0Zr-2.6Hf-1.0Cb-0.3Ru-0.4Si-0.3Ge. The alloy was evaluated in two forms, as rod that had been extruded at 1200° C., and also as a plate that had been forged at 1200° C. Four heat treatments were evaluated:

(1) 600° C. for 8 hours which is a conventional single step aging treatment for a titanium alloy processed above its beta transus;

(2) 1010° C. for 2 hours, cool to room temperature, plus 600° C. for 8 hours, which is a conventional two step aging treatment for a titanium alloys. For material which was processed above its beta transus (e.g. 1010° C.), the resultant microstructure consists of a mixture of coarse ($\alpha$ plates plus fine $\alpha$ plates; the coarse plates arise from the $\alpha$ that remained present at the 1010° C. the fine plates arise as a transformation product from the beta phase present at 1010° C. For material that was processed below its beta transus, the resultant microstructure consists of a mixture of equiaxed $\alpha$ particles plus fine $\alpha$ plates; the equiaxed ($\alpha$ particles arise from the $\alpha$ that was present at the 1010° C. the fine plates arise as a transformation product from the beta phase present at 1010° C.;

(3) 1010° C. for 2 hours, cool to room temperature, plus 800° C. for 24 hours, cool in 2 hours to 750° C. plus 750° C. 24 hours, cool in 1 hour to 700° C., plus 700° C. 24 hours, cool in 1 hour to 650° C., plus 650° C. 24 hours. The 1010° C. exposure will produce the mixed $\alpha$ plate size as in (2) above. The stepped age from 800° C. through 650° C. was carried out in order to evaluate any effects of aging on mechanical behavior. One effect of the stepped aging could be to cause any precipitates of $\alpha 2$ to be coarse. The coarse precipitates would be achieved by exposures just under the $\alpha/\alpha 2$ solvus, to permit only a few particles of $\alpha 2$ to nucleate, followed by long time thermal exposures at successively lower temperatures, allowing sufficient time at each temperature for the $\alpha 2$ phase to approach equilibrium volume fraction via growth on existing $\alpha 2$ phase rather than nucleation of new particles; and (4) 800° C., 100 hours, cool to 650° C. in 1000 hours. The objective of the heat treatment was to begin at a temperature near or above the $\alpha/\alpha 2$ solvus and cool sufficiently slowly to permit growth of additional $\alpha 2$ on the $\alpha 2$ particles remaining after the 800° C. hold, and to cause any additional $\alpha 2$ precipitates that form to be coarse.

Room temperature tensile tests were conducted on materials in the as-heat treated condition and also after unstressed thermal exposure and stressed thermal exposure. Unstressed thermal exposures were at 650° C. for 100 hours. This exposure was carried out on machined tensile bars wrapped in tantalum foil and encapsulated in fused silica ampules containing a partial pressure of argon. Stressed (creep) exposure was carried out at 650° C., 25 ksi, in air, for 100 hours or 600° C. 40 ksi in air for 100 hours. The exposed specimens were tested without removal of any surface contamination or oxide.

Example 1

Sections of the 1200° C. forging and 1200° C. extrusion were given the heat treatment of 600° C. 8 hours. The tensile results, listed below, exhibit severe loss in ductility and strength after stressed or unstressed thermal exposure. As heat treated forging yield strength and ductility are about 143 ksi and 2.7% tensile elongation, respectively; after 100 hour creep exposures, these values decrease to about 120 ksi ultimate strength and essentially nil tensile ductility; and after an unstressed thermal exposure, the yield strength is 122 to 151 ksi, but the tensile elongation is 0.1 to 0.9%. As heat treated extrusion yield strength and ductility are 164 to 171 ksi and 4.5 to 6.6% tensile elongation, respectively; after 100 hour creep exposures, these values decrease to about 88 ksi ultimate strength and zero tensile ductility. Tensile ductility is reduced to essentially zero on creep exposure of the material given a 600° C., 8 hour heat treatment. There is scatter in the strength results after unstressed exposure, but both ductilities are reduced greatly from those of unexposed material.

TABLE 1

| Condition | 0.2% YS ksi | UTS ksi | % Tensile Elongation | Process |
|---|---|---|---|---|
| AS HT:600° C./8 h | 142.6 | 149.3 | 2.7 | Forging |
| As HT:600° C./8 h | 164.4 | 174.9 | 6.6 | Extrusion |
| As HT:600° C./8 h | 170.6 | 180.8 | 4.5 | Extrusion |
| HT600° C./8 h plus 100 hour air creep as below: | | | | |
| 600° C./40 ksi | 124.7 | 124.7 | 0.0 | Forging |
| 600° C./40 ksi | 119.0 | 119.0 | 0.0 | Forging |
| 650° C./25 ksi | 120.7 | 120.7 | 0.1 | Forging |
| 650° C./25 ksi | 87.7 | 87.7 | 0.0 | Extrusion |
| HT 600° C./8 h plus 650° C., 100 hour exposure encapsulated in Y-gettered argon: | | | | |
| Exposed | 121.9 | 121.9 | 0.1 | Forging |
| Exposed | 150.7 | 154.6 | 0.9 | Forging |

Example 2

A section of the 1200° C. forging was given the heat treatment of 1010° C., 2 hours, cool to room temperature, plus 600° C., 8 hours. The tensile results, listed below, exhibit severe loss in ductility and strength after stressed or unstressed thermal exposure. As heat treated forging yield strength and ductility are 114 to 129 ksi and 5.6 to 8.6% tensile elongation, respectively; after 100 hour creep exposures, the strength is unchanged at about 130 ksi yield strength but the tensile ductility was reduced to 0.3%; and after an unstressed thermal exposure, the yield strength is 133 to 135 ksi, but the tensile elongation is reduced to 0.6 to 1.2%. Ductilities are reduced greatly by stressed or unstressed exposure from those of unexposed material.

TABLE 2

| Condition | 0.2% YS ksi | UTS ksi | % Tensile Elongation | Process |
|---|---|---|---|---|
| AS HT:1010/600 | 113.9 | 125.47 | 8.6 | Forging |
| As HT:1010/600 | 129.3 | 139.4 | 5.6 | Forging |
| HT 1010° C. plus 100 hour air creep as below: | | | | |
| 650° C./25 ksi | 130.7 | 130.7 | 0.3 | Forging |
| 1010° C./600° C. H.T., plus 650° C., 100 hour exposure encapsulated in Y-gettered argon: | | | | |
| Exposed | 133.4 | 135.4 | 0.6 | Forging |
| Exposed | 134.7 | 139.1 | 1.2 | Forging |

Example 3

A section of the 1200° C. extrusion was given the heat treatment of 1010° C., 2 hours, cool to room temperature, plus 800° C., 24 hours, cool in 2 hours to 750° C., plus 750° C. 24 hours, cool in 1 hour to 700° C., plus 700° C. 24 hours, cool in 1 hour to 650° C. plus 650° C. 24 hours. As heat treated extrusion yield strength and ductility are 143 to 147 ksi and 5.0 to 7.7% tensile elongation, respectively; after 100 hour creep exposures, the yield strength is essentially unchanged at about 151 ksi and tensile ductility reduced to 1.2%. Unstressed thermal exposure results in no loss in tensile strength or ductility. This heat treatment results in the least change on thermal exposure—essentially no change in tensile behavior for unstressed exposure, and the least loss in tensile ductility for creep exposures. The amount of ductility reduced in creep exposure of Example 3 is much less than that of the other examples, and this residual amount of loss may relate to environmental embrittlement from oxidation rather than thermal or stress induced instabilities.

TABLE 3

| Condition | 0.2% YS ksi | UTS ksi | % Tensile Elongation | Process |
|---|---|---|---|---|
| AS HT:1010(800–650) | 143.2 | 157.3 | 7.7 | Extrusion |
| As HT:1010/(800–650) | 146.9 | 158.1 | 5.0 | Extrusion |
| HT 1010(800–650) plus 100 hour air creep as below: | | | | |
| 650° C./25 ksi | 151.1 | 153.4 | 1.2 | Extrusion |
| HT 1010/(800–650) plus 650° C., 100 hour exposure encapsulated in Y-gettered argon: | | | | |
| Exposed | 147.1 | 158.9 | 6.8 | Extrusion |
| Exposed | 157.4 | 170.0 | 5.7 | Extrusion |

Example 4

A section of the 1200° C. extrusion was given the heat treatment of 800° C., 100 hours, cool in 1000 hours to 650° C. A heat treated extrusion yield strength and ductility are 157 to 158 ksi and 5.6 to 8.3% tensile elongation, respectively; after 100 hour creep exposure, the yield strength is 150 ksi and tensile ductility reduced to 1.1% elongation. The amount of ductility reduced in creep exposure of Example 4 is less than that of the specimens given the 600° C., 8 hour age of Example 1.

TABLE 4

| Condition | 0.2% YS ksi | UTS ksi | % Tensile Elongation | Process |
|---|---|---|---|---|
| as HT:800° C., 100 hours, cool to 650° C. in 1000 hours | 158.2 | 174.0 | 5.6 | Extrusion |
| as HT:800° C., 100 hours, cool to 650° C. in 1000 hours | 156.6 | 168.9 | 8.3 | Extrusion |
| HT 800° C., 100 hours, cool to 650° C. in 1000 hours, 650° C./25 ksi | 149.8 | 153.3 | 1.1 | Extrusion |

What is claimed is:

1. A method of heat treating a Ti/Al-base alloy, comprising the steps of:

selecting a Ti/Al-base alloy having an Al concentration such that the alloy comprises a mixture of α and α2 phases under equilibrium conditions at room temperature, wherein the α2 phase occupies at least 25 volume percent of the alloy at room temperature;

heat treating the alloy at a temperature which is above α/α2 solvus temperature of the alloy for a time sufficient to dissolve substantially all of the α2 phase;

forming a plurality of α2 particles within the alloy by cooling the alloy to a temperature which is in the range of about 1°–200° C. less than the α/α2 solvus temperature of the alloy;

cooling the alloy slowly to a temperature of about 650° C. or less, wherein the rate of cooling is sufficiently slow to permit the formation of an additional quantity of the α2 phase consistent with the phase equilibria relationships of the alloy and to permit substantially all of the additional quantity of α2 to be formed on the existing α2 particles.

2. The method of claim 1, wherein said step of cooling is performed as a plurality of discrete cooling steps.

3. The method of claim 2, wherein the plurality of discrete cooling steps comprises a plurality of aging heat treatment cycles having a starting temperature, an ending temperature, and an aging time, each successive cycle having a lower starting temperature than the starting temperature of the previous cycle, and wherein the aging time of each cycle is sufficiently long to permit the formation of substantially all of an equilibrium amount of the α2 phase associated with the aging temperature of that cycle.

4. The method of claim 3, wherein the aging time for each of the aging heat treatment cycles is in the range of 0.5–100 hours.

5. The method of claim 1, wherein said step of cooling is done by continuous cooling.

6. The method of claim 1, wherein the alloy comprises at least one element from the group consisting of Sn, Ga and In.

7. The method of claim 1, wherein the room temperature tensile elongation of the alloy after the completion of the heat treating is at least 5%.

8. A method of heat treating a Ti/Al-base alloy, comprising the steps of:

selecting a Ti/Al-base alloy having an Al concentration such that the alloy comprises a mixture of α and α2 phases under equilibrium conditions at room temperature, wherein the α2 phase occupies at least 25 volume percent of the alloy at room temperature;

heat treating the alloy at a subsolvus temperature in the range of 1°–200° C. below a $\alpha/\alpha 2$ solvus temperature of the alloy for a time sufficient to form substantially all of an equilibrium amount of the $\alpha 2$ phase associated with the subsolvus temperature, in the form of a plurality of $\alpha 2$ particles;

cooling the alloy slowly to a temperature of about 650° C. or less, wherein the rate of cooling is sufficiently slow to permit the formation of an additional quantity of the $\alpha 2$ phase consistent with the phase equilibria relationships of the alloy and to permit substantially all of the additional quantity of $\alpha 2$ to be formed on the existing $\alpha 2$ particles.

9. The method of claim 8, wherein said step of cooling is performed as a plurality of discrete cooling steps.

10. The method of claim 9, wherein the plurality of discrete cooling steps comprises a plurality of aging heat treatment cycles having a starting temperature, an ending temperature, and an aging time, each successive cycle having a lower starting temperature than the starting temperature of the previous cycle, and wherein the aging time of each cycle is sufficiently long to permit the formation of substantially all of an equilibrium amount of the $\alpha 2$ phase associated with the aging temperature of that cycle.

11. The method of claim 10, wherein the aging time for each of the aging heat treatment cycles is in the range of 0.5–100 hours.

12. The method of claim 8, wherein said step of cooling is done by continuous cooling.

13. The method of claim 8, wherein the alloy comprises at least one element from the group consisting of Sn, Ga, and In.

14. The method of claim 8, wherein the room temperature tensile elongation of the alloy after the completion of the heat treating is at least 5%.

* * * * *